US006239749B1

(12) United States Patent
Tzuang et al.

(10) Patent No.: US 6,239,749 B1
(45) **Date of Patent: *May 29, 2001**

(54) FAST-WAVE RESONANT ANTENNA WITH STRATIFIED GROUNDING PLANES

(75) Inventors: Ching-Kuang Tzuang, Hsinchu; Tsan-Hsi Lin, Tao-Yuan, both of (TW)

(73) Assignee: Ching-Kuang Tzuang, Hsinchu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,703

(22) Filed: Jan. 29, 1999

(51) Int. Cl.[7] ..... H01Q 1/38
(52) U.S. Cl. ..... 343/700 MS; 343/772; 343/829

(58) Field of Search ..... 343/700 MS, 702, 343/895, 731, 772, 829; H01Q 1/38

(56) References Cited

U.S. PATENT DOCUMENTS

| | | | | |
|---|---|---|---|---|
| 5,453,754 | * | 9/1995 | Fray | 343/789 |
| 5,703,600 | * | 12/1997 | Burrell et al. | 343/700 MS |
| 5,796,367 | * | 8/1998 | Andersson | 343/700 MS |
| 5,963,181 | * | 10/1999 | Abe | 343/895 |
| 5,966,097 | * | 10/1999 | Fukasawa et al. | 343/700 MS |

* cited by examiner

*Primary Examiner*—Don Wong
*Assistant Examiner*—Shih-Chao Chen
(74) *Attorney, Agent, or Firm*—Bacon & Thomas, PLLC

(57) ABSTRACT

An antenna based on the resonance phenomena of a fast-wave leaky mode is small in size, can be installed in a printed circuit board by using surface mounting technology, and can use dielectric materials with a relative permittivity of between 2 and 5.

3 Claims, 14 Drawing Sheets

Frequency form 240MHz to 300MHz

FAST-WAVE RESONANT ANTENNA WITH STRATIFIED GROUNDING PLANES

BACKGROUND OF THE PRESENT INVENTION

The present invention relates to a fast-wave resonator with stratified grounding planes, particularly to a small size fast-wave resonant antenna with stratified grounding planes which can be installed by surface mounting technology (SMT).

The hidden antenna is receiving more attention with the widespread use of mobile phones. Since the hidden antenna is small in size, it can be arranged into an RF circuit by surface mounting technology, thereby increasing its accuracy and thus improving the quality of the mobile phone.

A patch metal strip is used in a conventional hidden antenna. FIG. 1 shows a patch antenna wherein the medium substrate 11 is located on the grounding plane 12 and the patch 13 is located at the center of the upper surface of the medium substrate 11. Signals can be fed into the antenna from the feed line 14. Such configuration is commonly used in various active antennas.

FIG. 2 shows another kind of patch antenna. The difference between FIG. 2 and FIG. 1 is that the feed line 15 of FIG. 2 is extended along the upper surface of the medium substrate 11 and extended downward along the edge through the via hole of the substrate. Such configuration is used to make a surface mounting antenna.

FIG. 3 shows still another kind of conventional patch antenna which is similar to the patch antenna shown in FIG. 1. The main difference is that the signals are fed into the patch antenna via a probe or a coaxial line. It is obvious that connecting such kind of antenna with other microwave circuits using SMT technology may not be appropriate since a coaxial line needs a microwave connector to connect to an external coaxial cable.

According to a prior research result, the resonant frequency of the metal strip antenna is inversely proportional to $\sqrt{\epsilon_r}$($\epsilon_r$ being the relative permittivity). Under this restriction, dielectric materials with relative permittivity exceeding 20 are usually necessary for the miniaturized metal strip antennas depicted in FIG. 1 to FIG. 3. Moreover, it is known that limited dimension of the grounding plane greatly influences the performance of the metal strip antenna. Therefore, the dimension of the grounding plane should be greater than that of the patch so that the metal strip can work properly.

Besides, a hidden dielectric antenna used in a general integrated circuit can be designed by utilizing the resonance phenomena of the dielectric materials and coupling energy to a medium resonator via a metal strip or a slot line. However, dielectric materials with high relative permittivity are usually adopted in this kind of dielectric antenna because its size is also inversely proportional to $\sqrt{\epsilon_r}$.

Observe the simplified model of a monopole antenna depicted in FIG. 4(*a*), the length of the monopole antenna 42 on the housing of the mobile phone 41 is one-fourth the length of free-space wavelength. FIG. 4(*b*) shows a simplified model of a helix antenna, which is also used in mobile phones. The total length of this kind of helix antenna 43 is quite near to the free-space wavelength $\lambda_0$, therefore, it is obvious that both these kinds of antennas are not suitable to be used as hidden antennas in mobile phones. Besides, these two kinds of antennas use their housing as the grounding plane. The dimension of the grounding plane is always large, approximately $2\lambda_0^2$ in general design ($\lambda_0$ being free-space wavelength). The dimension of the grounding plane of the antenna is becoming smaller and smaller for downsizing of the mobile phones, thereby influencing the performance of the antenna.

SUMMARY OF THE PRESENT INVENTION

In view of the above, the present invention discloses a specially designed miniature antenna which utilizes a bound mode and a fast-wave leaky mode co-existing in a suspended metal strip. The respective modal currents and transverse electric field (magnetic field) of the bound mode and fast-wave leaky mode are very similar in the neighborhood of the metal strip. Therefore, a fast-wave resonant antenna with stratified grounding planes can be designed according to the resonance phenomena of the fast-wave leaky mode.

This antenna comprises a fast-wave resonator and a stratified and via grounding device, wherein the fast-wave resonator consists of a medium substrate which is cuboid in shape and a suspended metal strip cohering to the surface of the cuboid substrate. The shape of the cohering metal strip is determined based on the radiation field pattern required, and the cohering metal strip is compacted (i.e., confined) within a small range or area of the substrate surface. Signals are fed in from one end of the metal strip and the other end of the metal strip is open.

The grounding device is located below the fast-wave resonator. The grounding device is cuboid in shape and provided with a plurality of via holes, the via holes being rectangular and/or circular in shape, i.e., the via holes having at least one of the following shapes: (a) a rectangular shape, and (b) a circular shape, and the number and size of the rectangular and/or circular via holes being determined according to a grounding area required to provide a desired or predetermined structural strength.

Since the metal strip is confined within a small area of the substrate surface, while the grounding device provides a considerable area for grounding in a limited space, the size of the antenna can be reduced substantially. Moreover, this antenna can be directly installed in a printed circuit board (PCB) by using the surface mounting technology. In particular, the antenna in accordance with the present invention does not require dielectric materials with high relative permittivity, the dielectric materials with a relative permittivity between 2 and 5 are appropriate.

BRIEF DESCRIPTION OF THE DRAWINGS

FIG. 4(*b*) depicts another simplified model of a helix antenna in a conventional mobile phone;

FIG. 5(*b*) shows the propagation constants of the bound mode and fast-wave leaky mode;

FIG. 6(*b*) shows the longitudinal modal current distributions of the bound mode and the fast-wave leaky mode;

FIG. 9(*b*) depicts an enlarged partial view of FIG. 9(*a*);

FIG. 9(*c*) is a schematic diagram of FIG. 9(*a*);

FIG. 10(*b*) shows the part of the circumscribed circuit board which corresponds to the antenna in accordance with the above embodiment of the present invention;

FIG. 14(*b*) shows the current distributions on the opposite side of the metal strip in accordance with the above embodiment of the present invention at the resonant frequency of 260 MHz;

DETAILED DESCRIPTION OF THE PRESENT INVENTION

Figure 1:
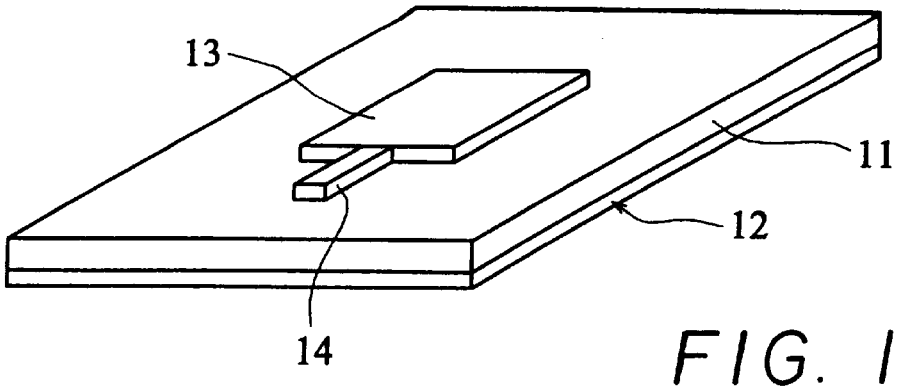
FIG. 1 (PRIOR ART)
FIG. 1 shows one kind of conventional patch antenna.
Figure 2:
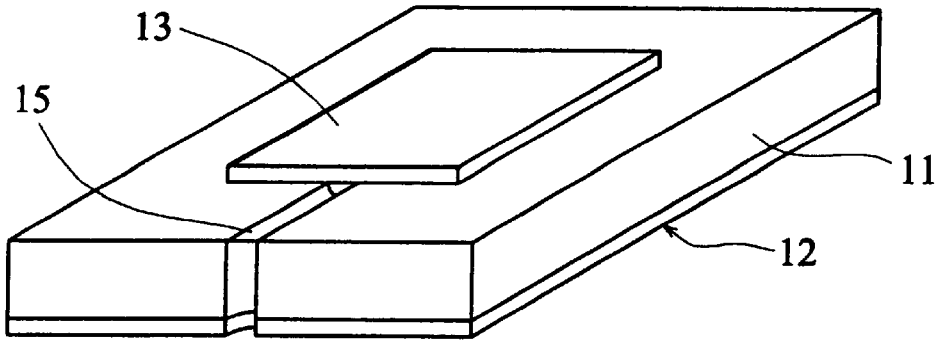
FIG. 2 (PRIOR ART)
FIG. 2 shows another kind of conventional patch antenna wherein signals are fed in from the via hole.
Figure 3:
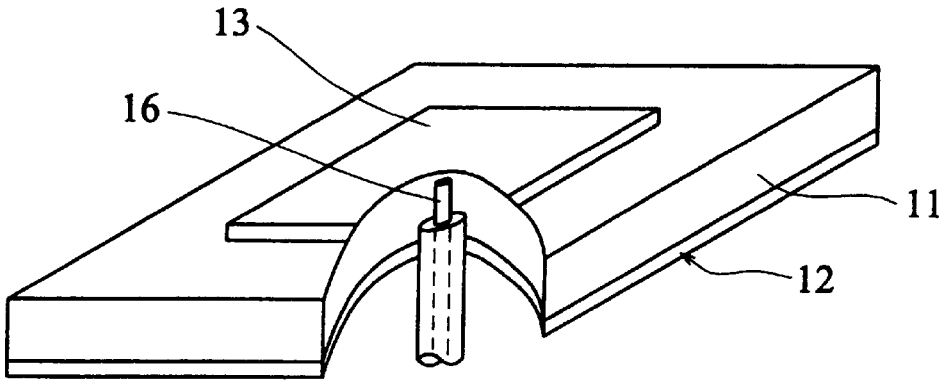
FIG. 3 (PRIOR ART)
FIG. 3 shows still another kind of conventional patch antenna wherein signals are fed in from a probe or a coaxial line.
Figure 4B:
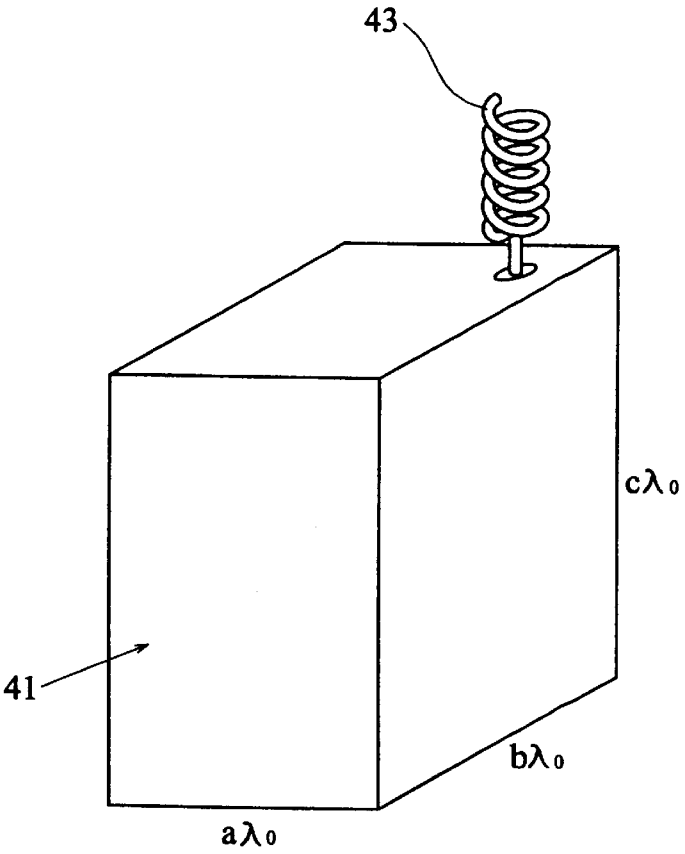
FIG. 4(b) (PRIOR ART)
FIG. 4(*a*) depicts a simplified model of a monopole antenna in a conventional mobile phone.
Figure 4A:
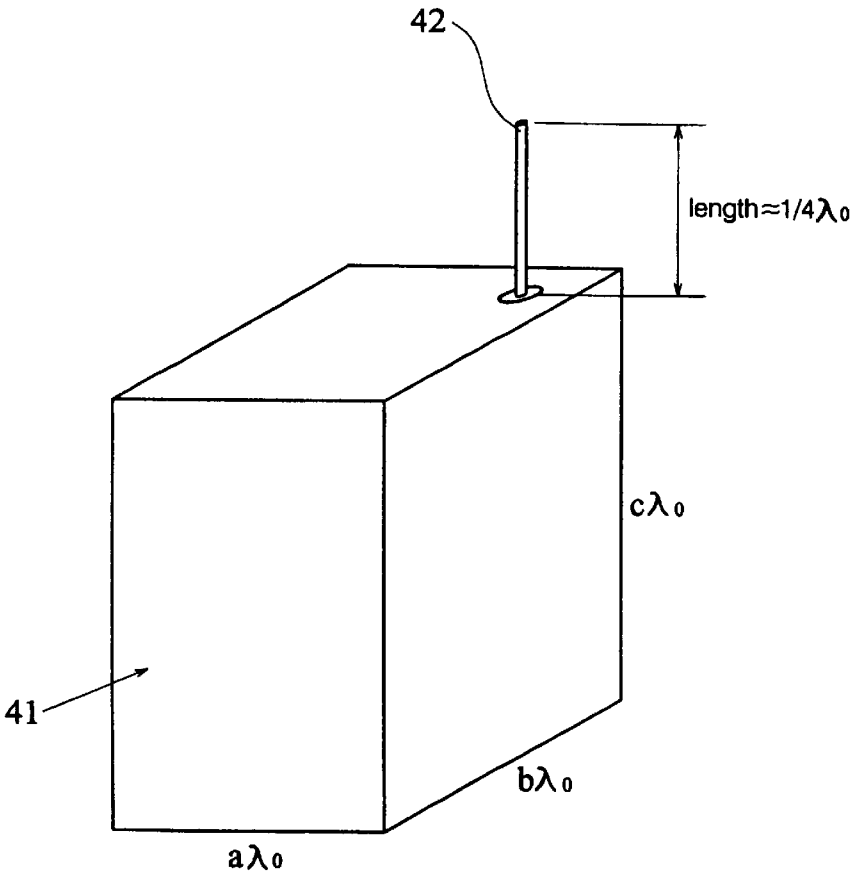
FIG. 4(a) (PRIOR ART)
Figure 5A:
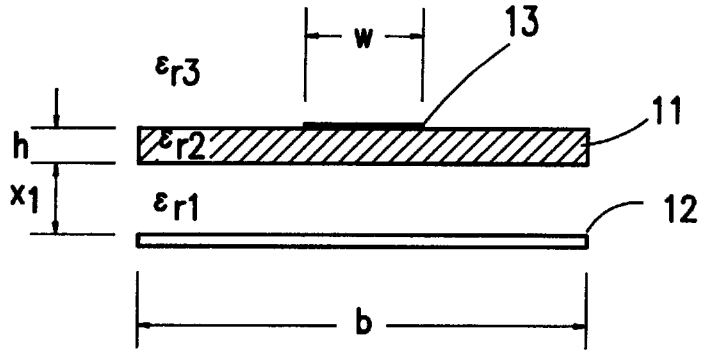
FIG. 5(*a*) is a cross-sectional view showing the structure of an ideal suspended metal strip.
Figure 5B:
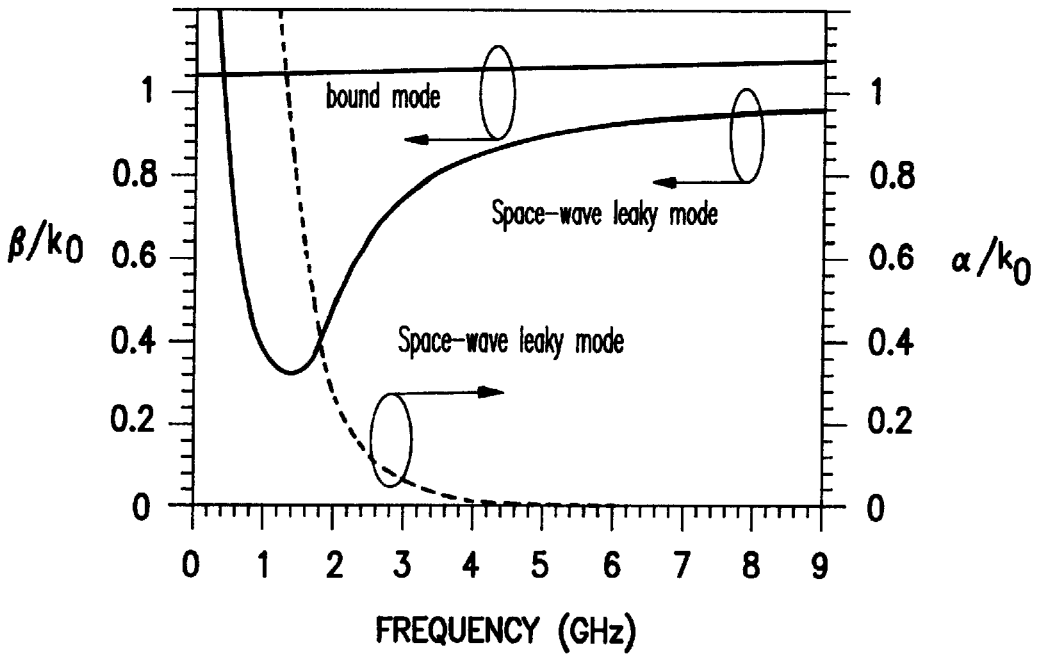

FIG. 5(*a*) shows a cross-sectional view of the ideal structure of the suspended metal strip having the following dimensions: $x_1$=300 mm, b=421.6 mm, w=1.6 mm, h=0.762 mm; $\in_{r1}$=1.0, $\in_{r2}$=2.1 and $\in_{r3}$=1.0 respectively. FIG. 5(*b*) depicts the aforementioned two modes of the suspended metal strip under the assumption that all metallic conductors of the metal strip in FIG. 5(*a*) have infinite conductivity. In other words, $\gamma_m=\beta_m-j\bullet 0=\beta_m$ and $\gamma_l=\beta_l-j\bullet_l$, wherein $\gamma_m$ and $\gamma_l$ represent the propagation constants of the bound mode and leaky mode, respectively; $\beta_m$ and $\beta_l$ represent the phase constants of the bound mode and leaky mode, respectively; $\alpha_l$ represents the attenuation constant of the leaky mode. Notice that the space-wave leaky mode has normalized phase constant ($\beta_1/k_0$) smaller than 1.

Figure 6A:
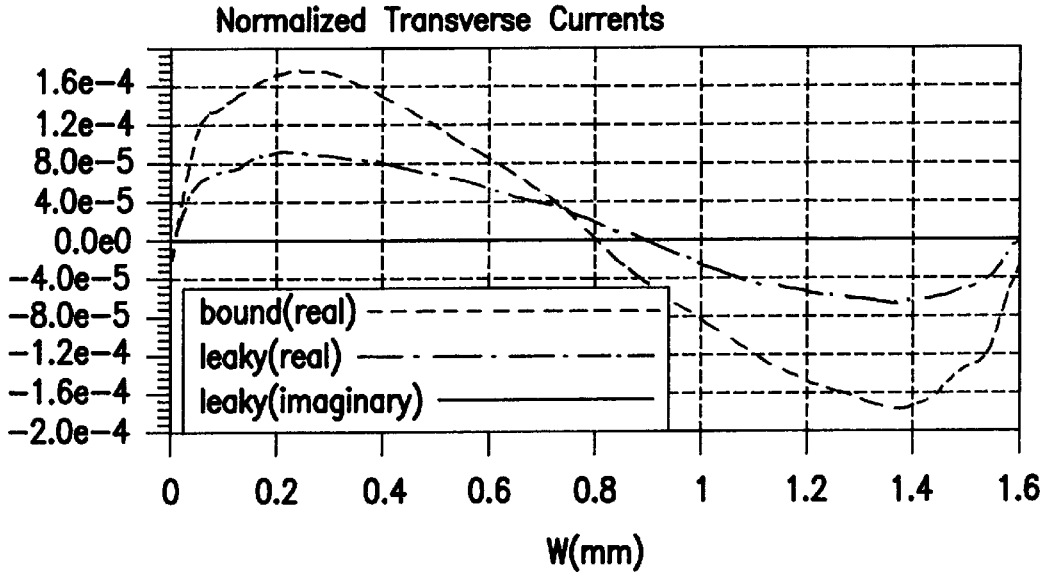
FIG. 6(*a*) shows the transverse modal current distributions of the bound mode and the fast-wave leaky mode.
Figure 6B:
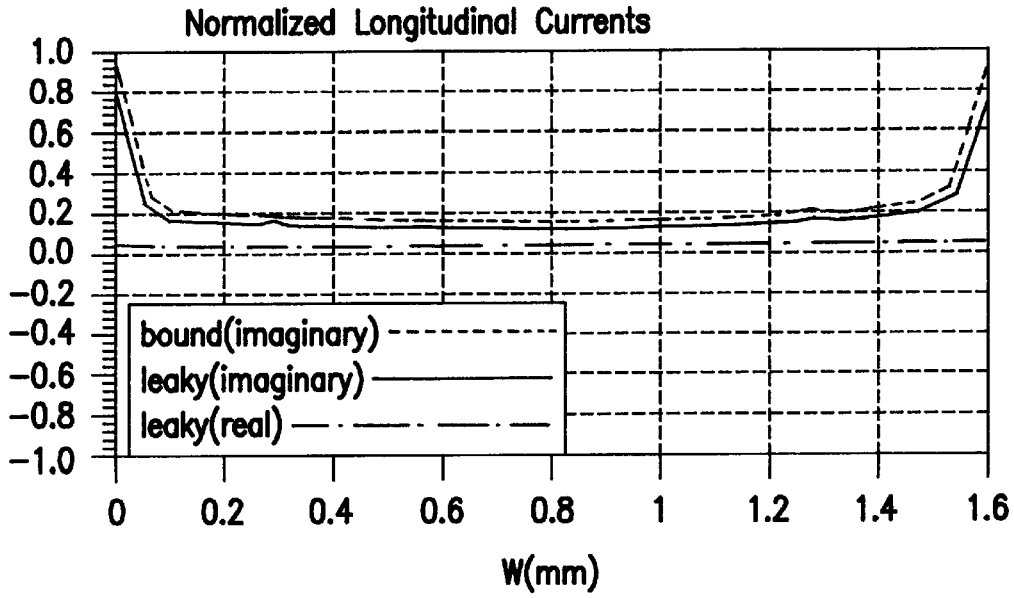

The transverse and longitudinal current distributions are depicted in FIGS. 6(*a*) and 6(*b*), respectively. Their modal currents in the transverse and longitudinal directions of the metal strip are quite similar. In other words, if one mode is excited, the other mode is excited as well.

Figure 7:
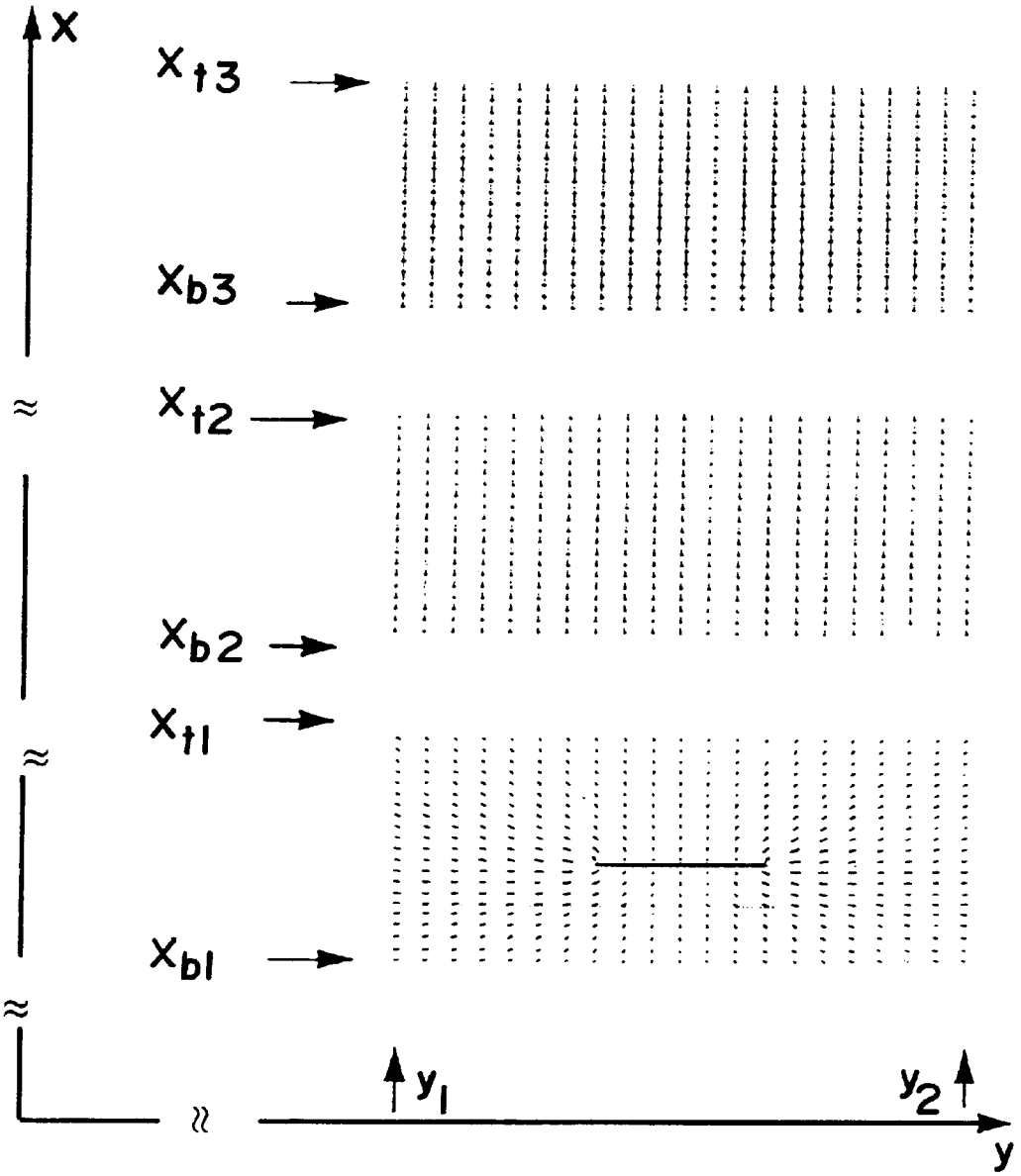
FIG. 7 depicts the electric field distributions of the leaky mode in transverse direction at different locations (heights) of the suspended metal strip.

Besides, their electric fields distributions near the metal strip are also similar. FIG. 7 shows the electric field distributions of the leaky mode in transverse plane at different locations of the suspended metal strip, wherein the parameters are as follows: (1) $X_{b1}$=299 mm, $x_{t1}$=303 mm, (2)$x_{b2}$=408 mm, $x_{t2}$=412 mm, (3)$x_{b3}$=677 mm, $x_{t3}$=681 mm, $y_1$=208.3 mm, $y_2$=213.3 mm. It can be seen from FIG. 7 that the attenuation constant of the leaky mode is not zero, resulting in an improper but physical solution with growing transverse fields.

A detailed analysis shows that the two modes are mutually coupled. In other words, integrations over the waveguide cross-sectional area, $\int \overline{E}_{(m)}\times\overline{H}_{(l)}{}^*ds$ and $\int \overline{E}_{(l)}\times\overline{H}_{(m)}{}^*ds$, are both non-zero, wherein $\overline{E}_{(m)}$ and $\overline{E}_{(l)}$represent the electrical field of the bound mode and the leaky mode, respectively; $\overline{H}_{(m)}$ and $\overline{H}_{(l)}$ represent the magnetic field of the bound mode and the leaky mode, respectively. In other words, when a bound mode is excited, the energy is partially converted into a leaky mode during its propagation. Then the leaky mode radiates the energy into free space during propagation. On the contrary, a leaky mode partially converts energy into a bound mode during propagation.

Figure 8:
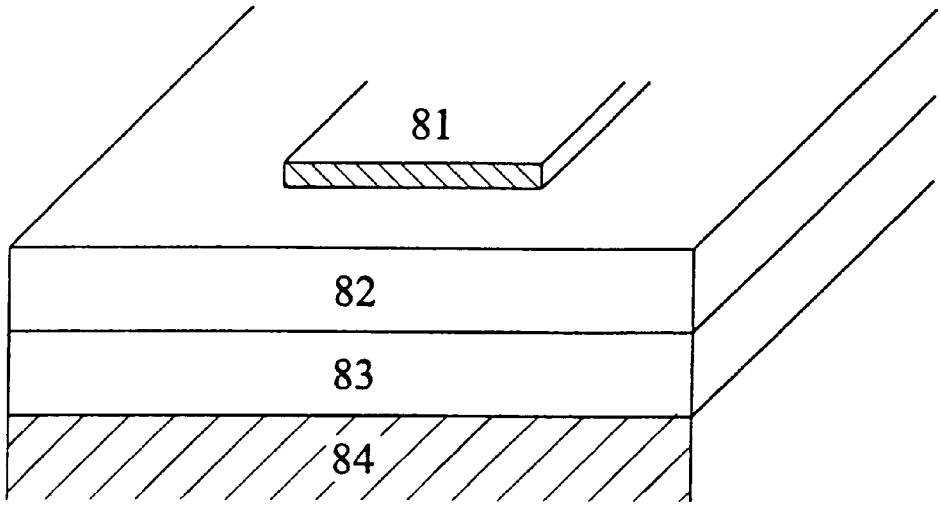
FIG. 8 shows the ideal structure of the suspended metal strip.

As shown in FIG. 8, the ideal suspended metal strip structure consists of a metal line 81, a medium substrate 82, an air zone 83 and a grounding plane 84. The space over the metal line 81 is also filled with air.

The antenna of the present invention is designed according to the above principle and the ideal suspended metal strip structure. It comprises a fast-wave resonator and a grounding device provided with a plurality of via holes.

Figure 9A:
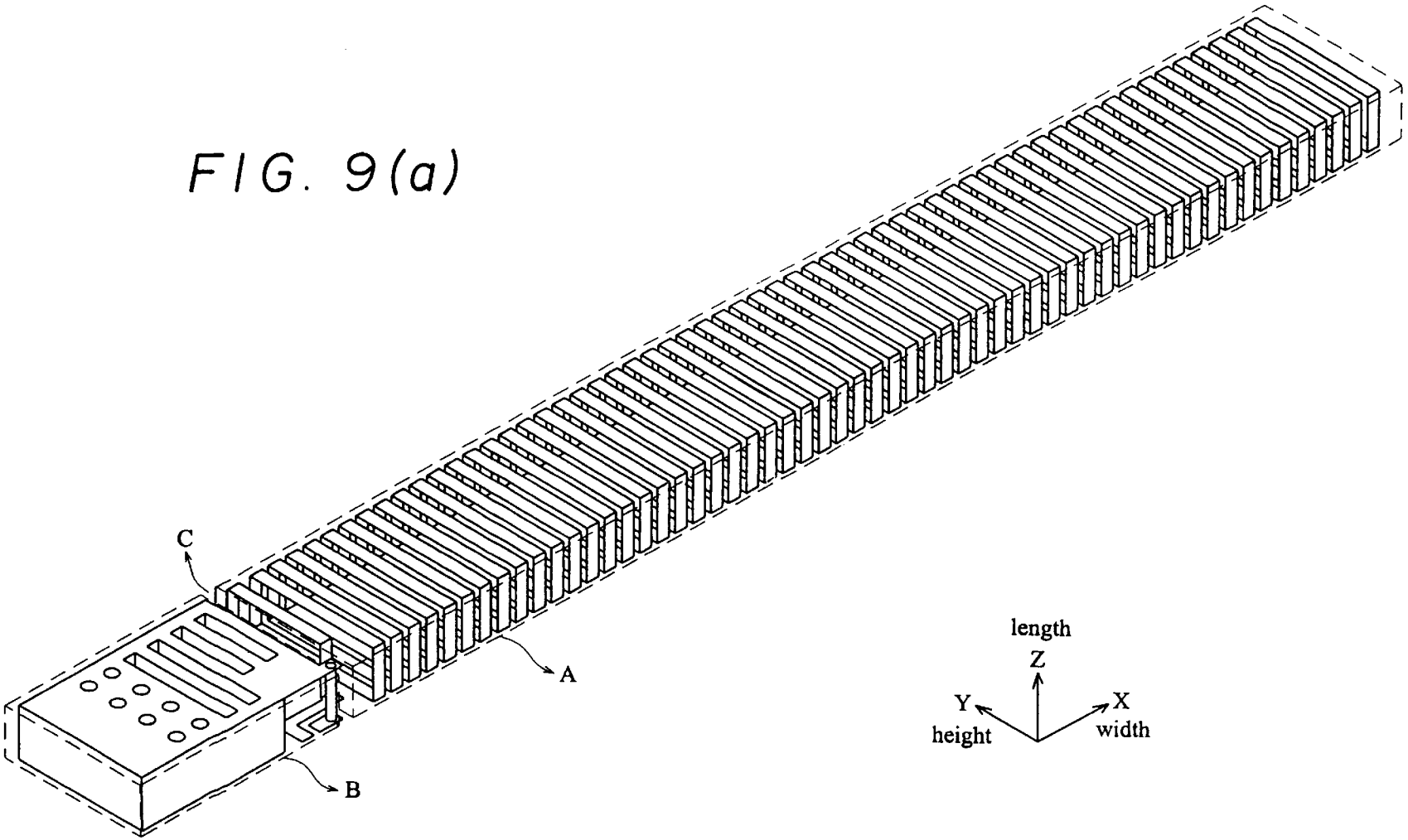
FIG. 9(*a*) depicts a preferred embodiment of the miniature fast-wave resonant antenna with stratified grounding planes in accordance with the present invention.
Figure 9B:
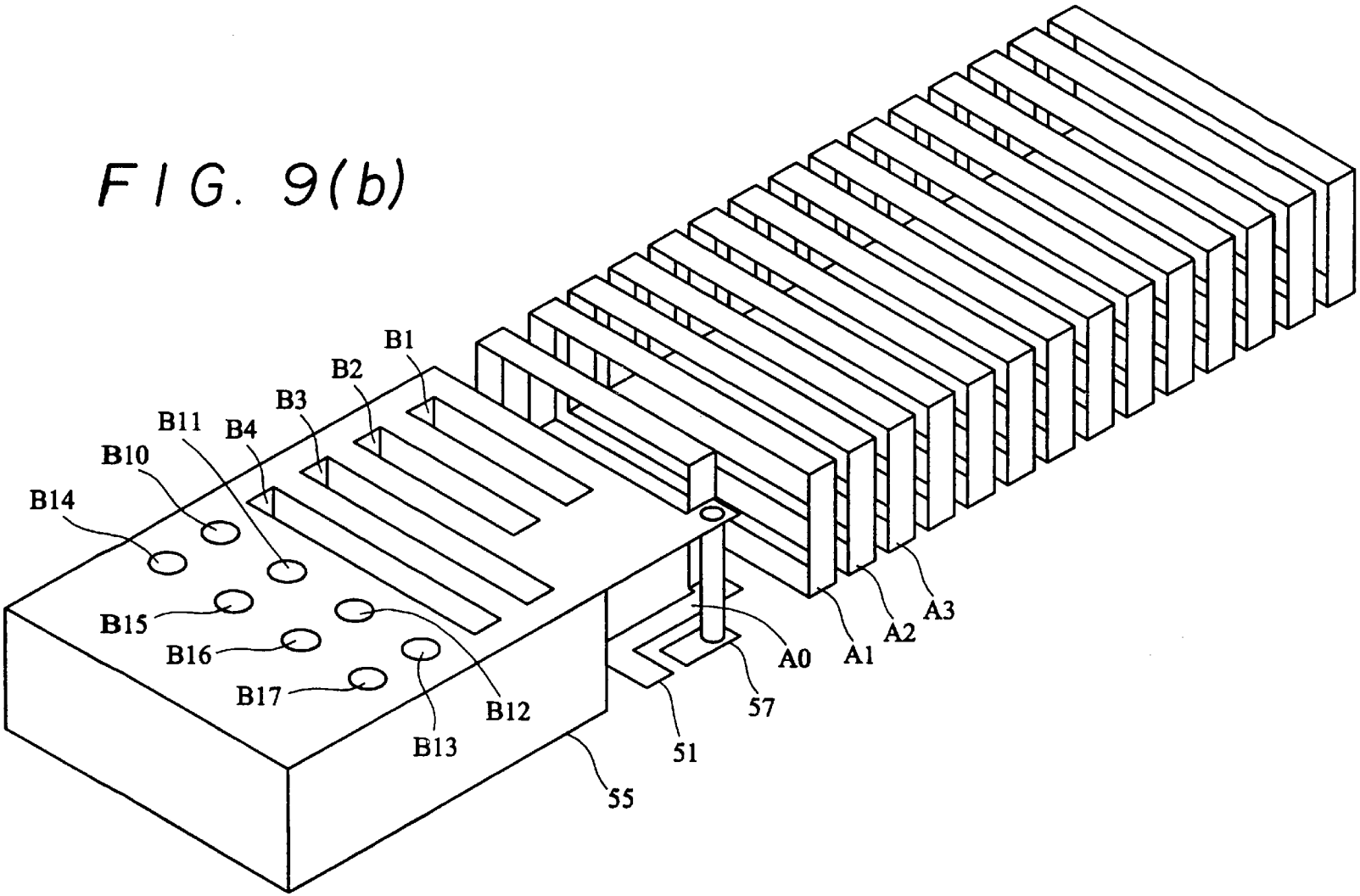
Figure 9C:
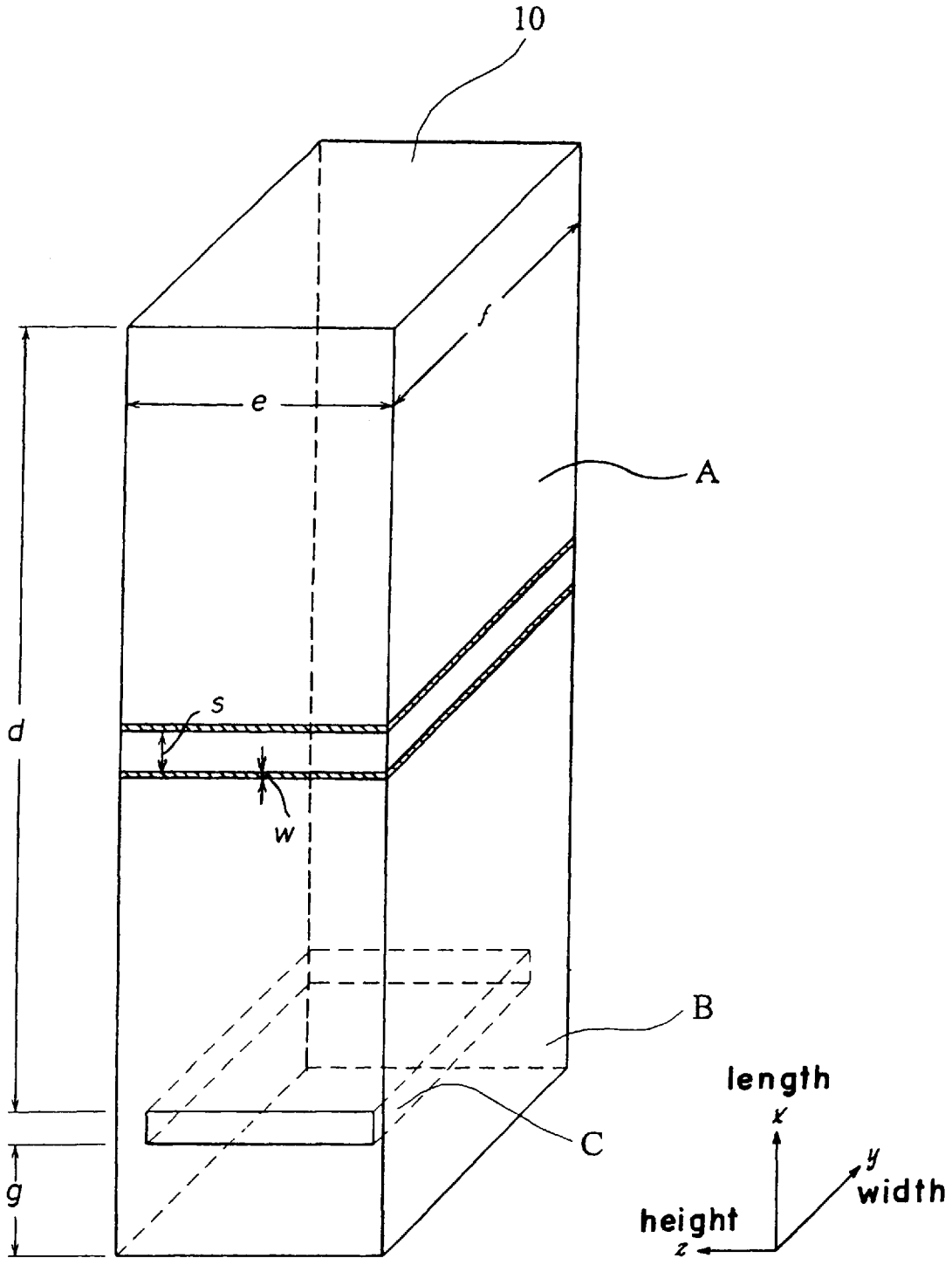

A preferred embodiment of the present invention is depicted in FIG. 9(*a*), wherein A denotes the fast-wave resonator and B denotes the grounding device. Furthermore, the dielectric material of the fast-wave resonator in A is removed in order to display the circuit of the fast-wave resonator clearly. Additionally, it is assumed that the directions of X axis, Y axis and Z axis of the three-dimensional space represent the length, width and height of the antenna, respectively. FIG. 9(*b*) is the enlarged partial view of FIG. 9(*a*).

In FIG. 8, the air zone 83 formed between the medium substrate and the grounding plane corresponds to the air zone C depicted in FIG. 9. The structure of the air zone C is formed by the technique of trenching and casting.

In FIG. 9(*b*), the fast-wave resonator A is composed of a cuboid medium substrate, and the metal strips A1, A2, A3, . . . which encircle the surface of the cuboid medium substrate to form a helix metal strip. One end of this helix metal strip is open to form an open circuit, which is required for resonating. The other end 51 is used for input/output of signals. This kind of fast-wave resonator can be fabricated by PCB technology or by the combination of casting and etching technologies.

Referring FIG. 9(*b*), the grounding device B is provided with a plurality of via holes. These via holes are categorized into two kinds: (a) via holes of the first kind, B1–B4, which are rectangular in shape, and (b) via holes of the second kind, B10–B17, which are circular in shape. The grounding area is increased dramatically by the presence of these via holes. Such structure can be derived by utilizing PCB technology or by utilizing the combination of casting and plating technologies.

In FIG. 9(*b*), the metal strip A0 extends along the surface of the dielectric cuboid to the end 51, An input/output of a coplanar waveguide is formed by the combination of the end 51 and the grounding ends 55 and 57 of the grounding device B.

Figure 10A:
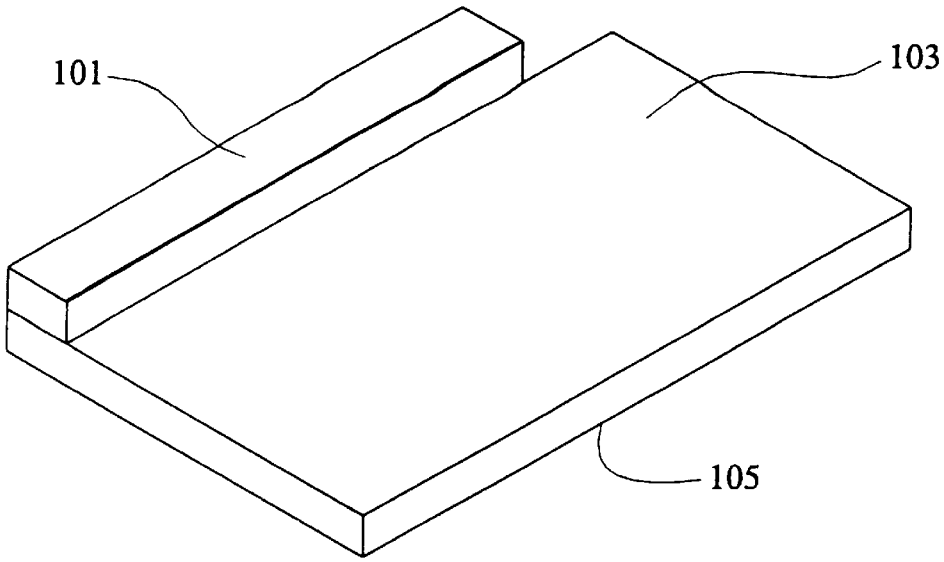
FIG. 10(*a*) depicts the situation where the antenna in accordance with the above embodiment of the present invention is installed in a circumscribed circuit board.
Figure 10B:
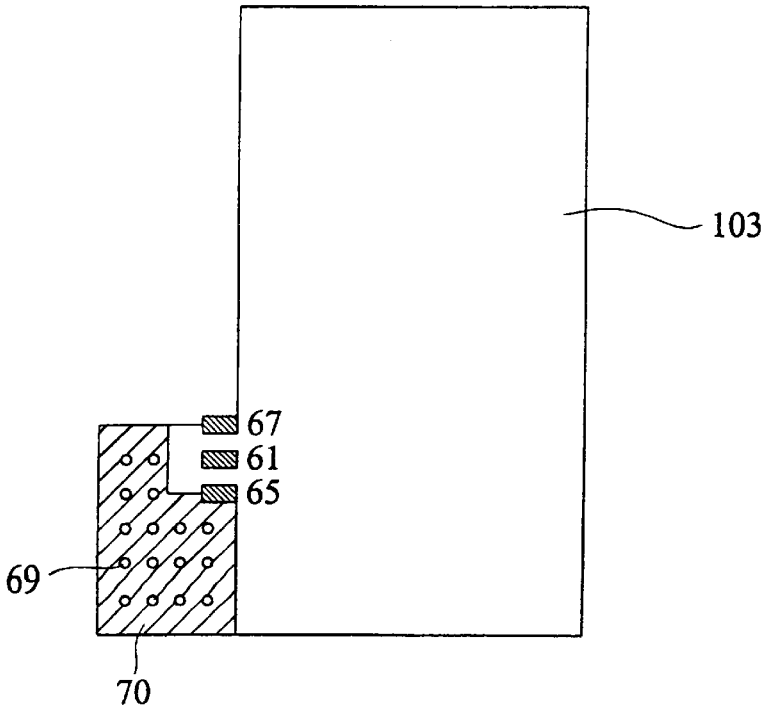

FIG. 10(*a*) illustrates an example in which the antenna 101 of the present invention is installed in a circumscribed circuit board 103. With reference to FIG. 10(*b*), the antenna is connected to the circumscribed circuit board in which the input/output terminals 61, 65 and 67 of the coplanar waveguide are formed, wherein terminal 61 is the signal input/output end, terminals 65 and 67 are grounding ends. By utilizing SMT, terminals 51, 55 and 57 are connected to terminals 61, 65 and 67, respectively, and the grounding device is connected to the grounding plane 105 of the circumscribed circuit board 103 via a plurality of via holes 69 in the circumscribed circuit board 103 and the metallic portion 70.

FIG. 9(*c*) is the schematic diagram of FIG. 9(*a*). With reference to FIG. 9(*c*), the design parameters in accordance with the above embodiment are as follows:

(1) the width and interval of the metal strip are $0.39\times10^{-3}\lambda_0$ and $0.17\times10^{-3}\lambda_0$, respectively. In other words, $w=0.39\times10^{-3}\lambda_0$; $s=0.17\times10^{-3}\lambda_0$.

(2) the length of the cuboid dielectric 10 is about $0.039\lambda_0$, wherein $d=0.032\lambda_0$; $g=7.0\times10^{-3}\lambda_0$.

(3) the width and height of the cuboid dielectric 10 are about $4.3\times10^{-3}\lambda_0$ and $1.47\times10^{-3}\lambda_0$. In other words, $f=4.3\times10^{-3}\lambda_0$; $e=1.47\times10^{-3}\lambda_0$.

(4) $\in_r=3.25$.

(5) the number of circles of the helix metal strip N=57.

Based on the above parameters, the volume of the antenna is about $0.25\times10^{-6}\lambda_0^3$; the average length is about $0.63\times10^{-2}$. Thus a miniature antenna circuit can be obtained.

Furthermore, the length of the helix metal strip is about:

$$5.8\times10^{-3}\lambda_0\times57\times2+0.17\times10^{-3}\lambda_0\times57=0.667\ \lambda_0$$

The total area of the helix metal strip is about:

$$0.667\lambda_0\times3.9\times10^{-4}\lambda_0=260\times10^{-6}\lambda^2_0$$

When resonance phenomenon occurs in the metal strip, the current intensity in the metal strip is similar to the variation of a cosine function between radian 0 to $\pi/2$, which is illustrated hereunder. The area formed by ¼ period of a cosine function is $2/\pi$, so that the average effective area of the helix metal strip is:

$$260\times10^{-6}\lambda^2_0\times2/\pi=166\times10^{-6}\lambda^2_0$$

Charges can be considered to be evenly distributed on the effective area $166\times10-6\lambda_0^2$ of the metal strip.

It is estimated that the grounding plane of the grounding device has area about $90.6\times10^{-6}\lambda_0^2$. While resonance phenomenon occurs, the positive charges Q (the quantity of charge) flow into the input end 51, enter the helix metal strip via the end A0, and then fill up the metallic surface of the metal strip. Simultaneously, a portion of the negative charges −Q flow into the grounding ends 55 and 57, fill up all the metallic surfaces of the grounding device. Another portion of the negative charges −Q flow into the grounding ends 65 and 67 of the circumscribed circuit and its grounding plane 105. Therefore, the helix metal strip, the stratified grounding device and the portion near the grounding end together maintain balance of the charge. It is evident that the area of the grounding is sufficient in the antenna of the present invention although it occupies much smaller space than the conventional antenna of the mobile phone.

Moreover, dielectric materials with high permittivity is not required in the antenna of the present invention. Concretely, a dielectric material with relative permittivity $\in_r$ between 2 and 5 can be used.

The important role played by the fast-wave leaky mode in the antenna of the present invention can be seen through the following description.

According to the theories of the microwave circuit, if the open end of a transmission line supporting a single mode has no fringing field effect (purely open), then a resonant circuit can be formed when the frequencies are at an odd multiple of the frequency corresponding to $\frac{1}{4}\lambda_g$ ($\lambda_g$: the transmission line wavelength of the single mode). The resonant equation corresponding to the first resonant frequency is:

$$l=\frac{1}{4}\times\frac{\lambda_0}{\beta}=\frac{1}{4}\lambda_g \tag{1}$$

Where l is the length of the metal strip; $\hat{\beta}$ is the normalized phase constant;

$$\hat{\beta}=\frac{\beta}{k_0};\ k_0=\frac{2\pi}{\lambda_0};\ \beta=\frac{2\pi}{\lambda_g};$$

and $k_0$ is the free space wave number.

Figure 11:
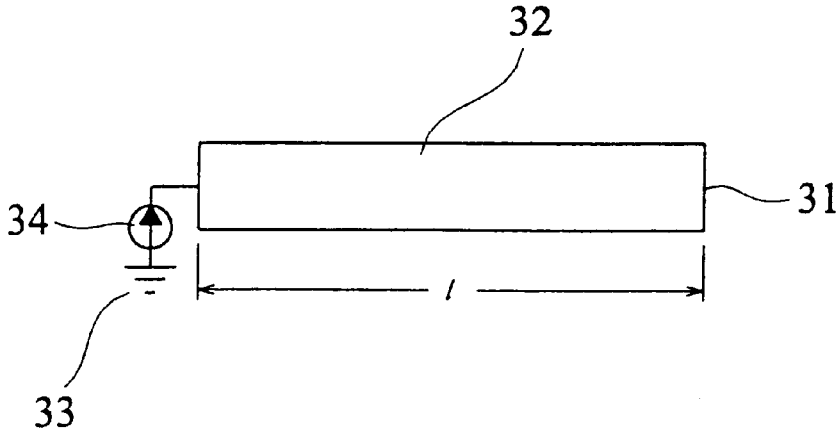
FIG. 11 is the equivalent circuit of the antenna in accordance with the above embodiment of the present invention.

The equivalent circuit of the antenna comprising an open end 31, a suspended metal strip 32, a ground 33 and a power source 34 is depicted in FIG. 11. Based on the above theories of microwave circuit, the length of the metal strip 32 is $\frac{1}{4}\lambda_g$ if FIG. 11 represents the resonant circuit corresponding to the first resonant frequency.

Based on the above design parameters, the first resonant frequency 260 MHz can be derived using the three-dimensional full-wave electromagnetic field theories. On the other hand, Smith chart and the reflection coefficient diagram of the corresponding input end can be obtained by measuring the one-port $S_{11}$ parameter (scattering parameter) of the antenna constructed with the above design parameters, as shown in FIGS. 12 and 13, respectively.

Figure 12:
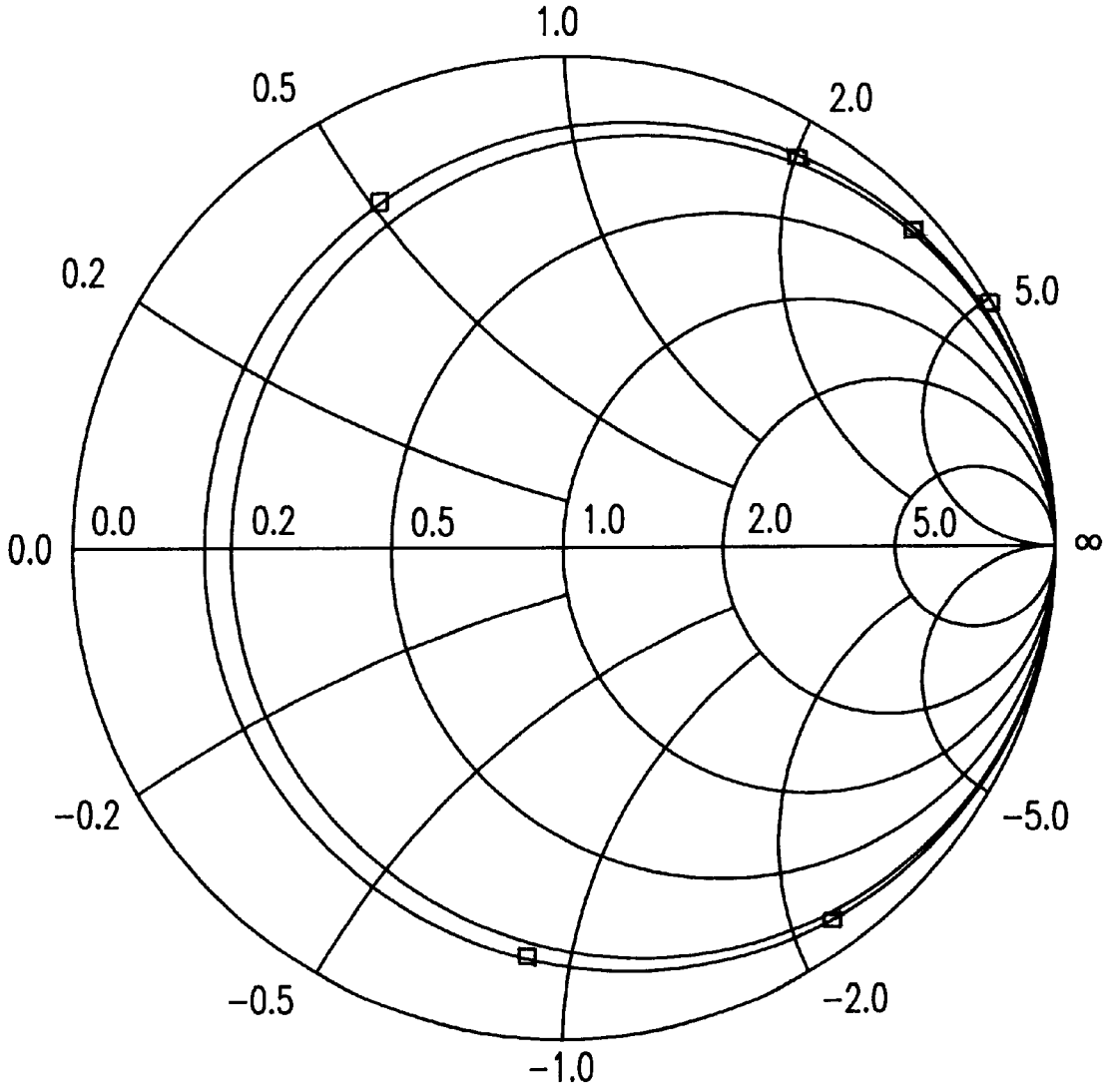
FIG. 12 depicts the measured results of the one-port Smith chart in accordance with the above embodiment of the present invention.
Figure 13:
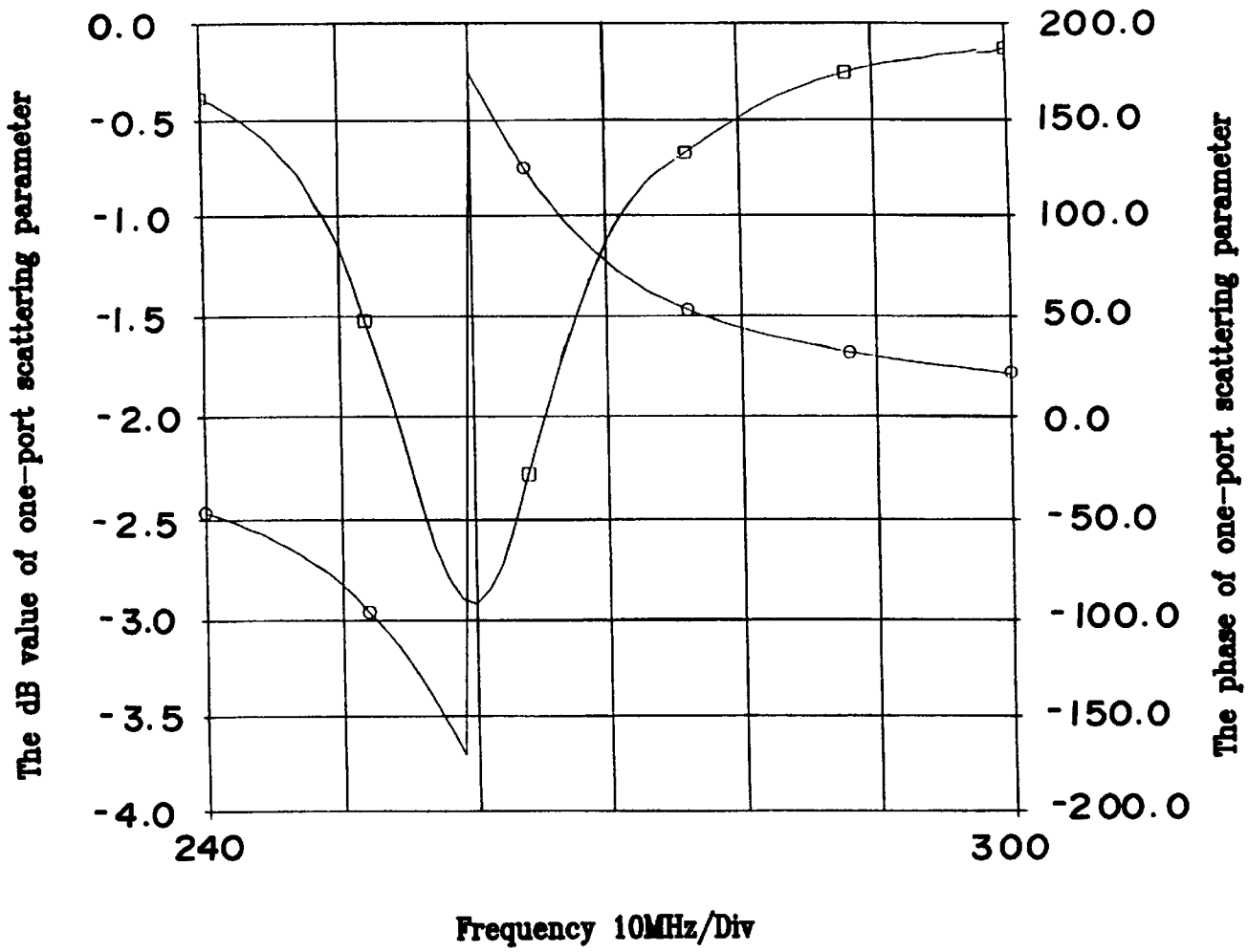
FIG. 13 depicts the measured results of the one-port scattering parameter in accordance with the above embodiment of the present invention.

In FIG. 12, the vector analyzer is used to scan from 240 MHz to 300 MHz. Using Smith chart, the curve starts from a point at the neighborhood of the rightmost end corresponding to an open circuit, it moves in clockwise direction to a point near the leftmost end corresponding to a short circuit, then it stops at a point corresponding to 300 MHz, which is at a right upper part of the Smith chart. After a detailed analysis, it is known that the frequency corresponding to the point closest to the short circuit end of the Smith chart is at the operating frequency of 259 MHz, which corresponds to the phase 180° . The frequency 259 MHz is the measured result of the first resonant frequency which differs from the theoretical value 260 MHz by 1 MHz only.

The first resonant frequency can be further verified as described in the following. With reference to FIG. 13, $S_{11}$ parameter has the least value of about −2.8 dB at 259 MHz corresponding to the phase of 180° while resonance phenomenon occurs. The reflection coefficient $S_{11}$ (in dB value) of the input end of the resonator with length of ¼ wavelength ($\frac{1}{4}\lambda_g$) depicted in FIG. 11 must be negative and correspond to phase 180° . The absolute value of $S_{11}$ is less than 1 (<0 dB) since the fast-wave leaky mode emits energy into free space.

Thus, with respect to the first resonant frequency, when the length l of the metal strip in the equation (1) is substituted as $0.667\ \lambda_0$, the value of $\hat{\beta}$ is 0.375. The phase velocity of the leaky mode corresponding to this $\hat{\beta}$ value is:

$$c/\hat{\beta}=2.66c \tag{2}$$

where c is the light speed. Equation (2) denotes that the phase velocity of this leaky mode is 2.66 times as fast as the light speed. Therefore, this leaky mode is a fast wave.

Figure 14A:
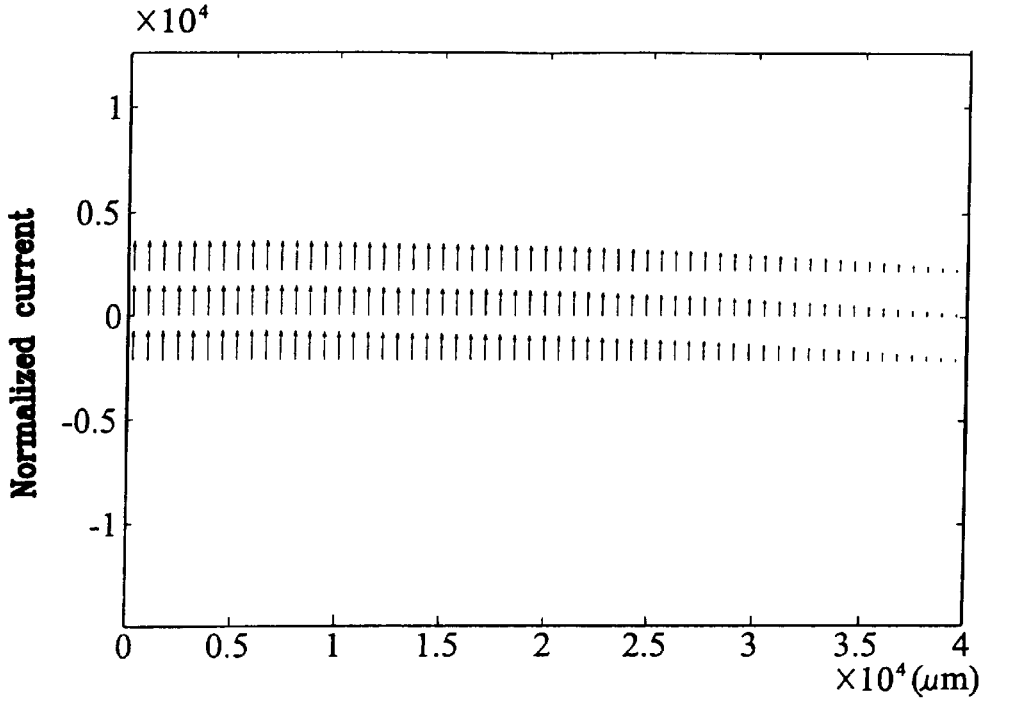
FIG. 14(*a*) shows the current distributions on one side of the metal strip in accordance with the above embodiment of the present invention at the resonant frequency of 260 MHz.
Figure 14B:
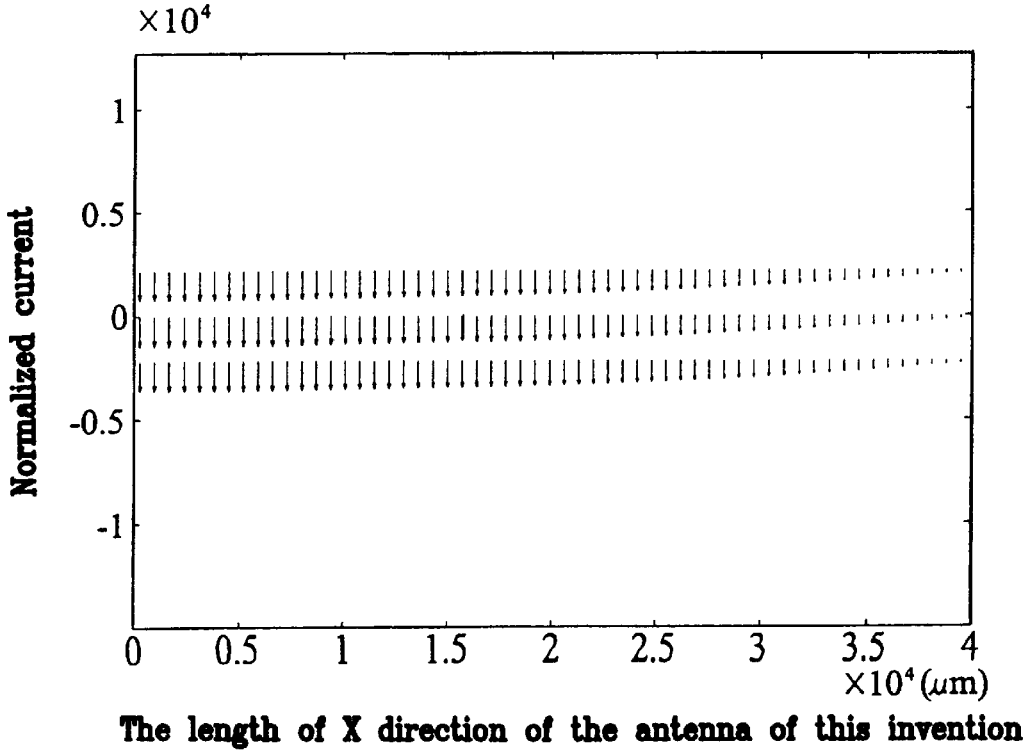

Furthermore, when resonance phenomenon occurs at frequency 260 MHz, the current distributions on one side and the opposite side of the metal strip (depicted in part A of FIG. 9(*a*)) can be derived by using three-dimensional full-wave electromagnetic field theories. Referring to FIGS. 14(*a*) and 14(*b*), which show that the current intensity at the input end of the metal strip is the greatest, and the current intensity gradually decreases along the X direction of FIG. 9(*a*). However, the direction of current intensity does not change. The current flows towards the open end (the edge of the resonator) and its intensity becomes zero at the open end. In other words, the intensity of the modal current in the metal strip is similar to the variation of a cosine function between radian 0 to $\pi/2$. Therefore, such resonance can only be obtained by the leaky mode according to the above analysis.

In summary, it can be seen that the transmission of the antenna of the present invention is mainly based on the fast-wave leaky mode.

Figure 15:
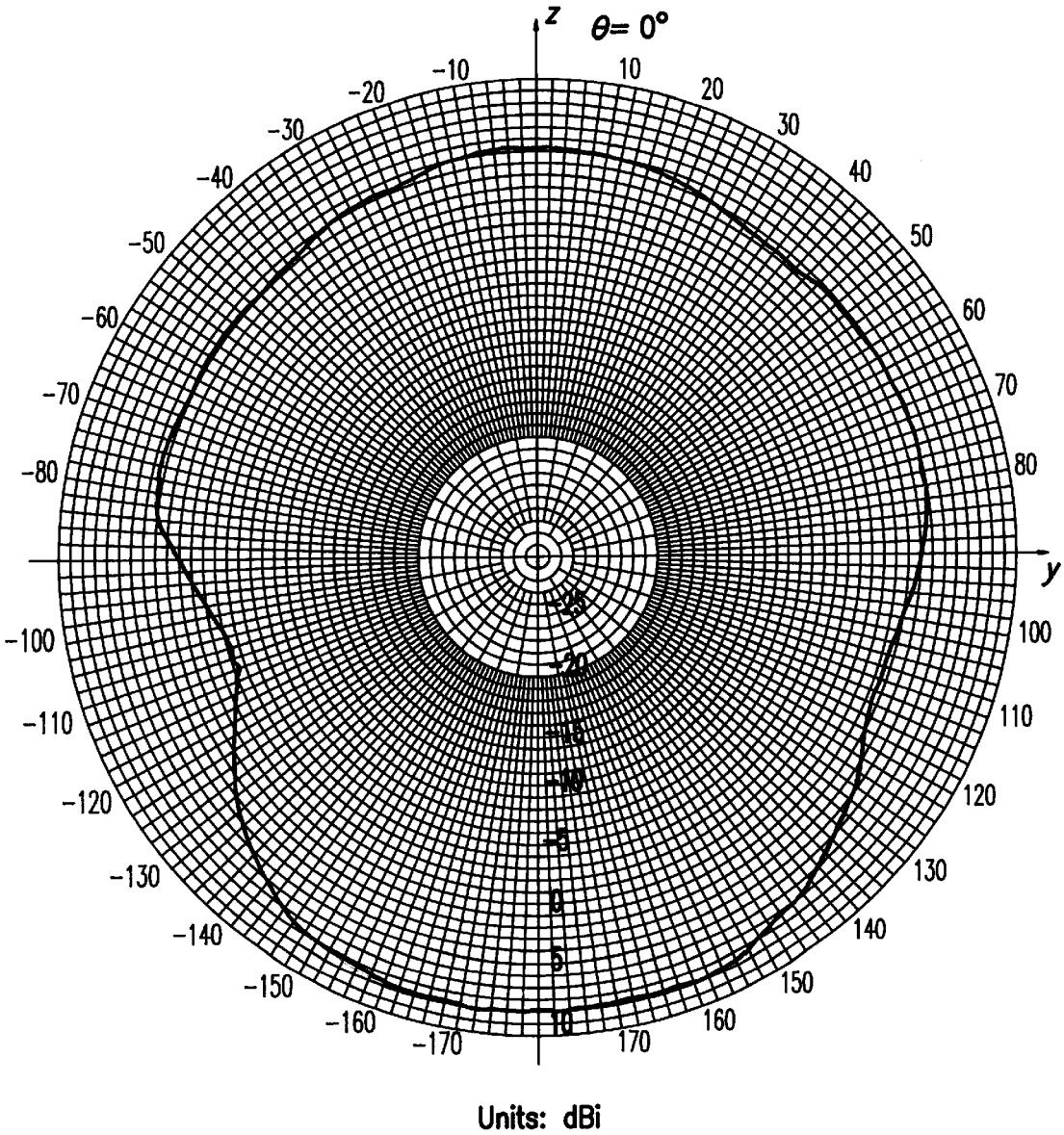
FIG. 15 shows the measured radiation field pattern of the Y-Z plane of the antenna in accordance with the above embodiment of the present invention at the resonant frequency of 260 MHz.

FIG. 15 shows the measured radiation field pattern in accordance with the above embodiment of the antenna at Y-Z plane at a resonant frequency 260 MHz, wherein angle θ represents the angle resulted from the Z-axis and the line formed by a certain point to the origin. As is apparent from FIG. 15, the radiation field pattern is similar to that of the monopole antenna on an infinite planar grounding plane although the gain is much larger.

The above is an embodiment of the present invention. However, the present invention is not limited by the embodiment. For example, with reference to the structure of the antenna depicted in FIG. 9(*b*), actually, the region between the micro strip of the fast-wave resonator and surface of the stratified and via grounding device is filled with air. This is similar to the air zone 83 depicted in FIG. 8. Therefore, the air zone C is not indispensable. Accordingly, there is another kind of antenna without air zone C. In this situation, the dielectric materials of the fastwave resonator A and the stratified grounding device B are directly connected together without any air zone.

The metal strip is not only helix in shape. Metal strips with different shapes based on the shapes of the radiation field pattern required can be used in a fast-wave resonator. For example, the metal strip can be a plurality of parallel closed loops, and the method of design is similar to that of the above embodiment.

Furthermore, the antenna of the present invention can use a feed-line to input/output the signal directly, too. In this situation, the corresponding location of the circumscribed substrate also forms the direct input/output terminal. Then the end of the metal strip of the fast-wave resonator which is used for input and output is directly connected to the corresponding input/output terminal of the circumscribed circuit board using SMT technology.

Thus, changes and variations may be made without departing from the spirit or scope of the following claims.

What is claimed is:

1. A fast-wave resonant antenna with stratified grounding planes, comprising:

a fast-wave resonator consisting of first and second portions, the first portion being a medium substrate which is cuboid in shape and the second portion being a metal strip cohering to the surface of said medium substrate, a shape of said cohering metal strip being determined based on a radiation field pattern required and being confined within a small area of said substrate surface, a first end of said metal strip being used to feed in signals and a second end of said metal strip being open;

a grounding device located below said fast-wave resonator, said grounding device being cuboid in shape and provided with a plurality of via holes, said via holes having a rectangular shape, wherein a number and size of the via holes having a rectangular shape is determined according to a grounding area required to provide a predetermined structural strength, and whereby said grounding device provides a considerable area for grounding in a limited space.

2. A fast-wave resonant antenna with stratified grounding planes as set forth in claim 1, wherein the medium substrate of said fast-wave resonator is composed of a dielectric material having a relative permittivity ranging from 2 to 5.

3. A fast-wave resonant antenna with stratified grounding planes, comprising:

a fast-wave resonator consisting of first and second portions, the first portion being a medium substrate which is cuboid in shape and the second portion being a metal strip cohering to the surface of said medium substrate, a shape of said cohering metal strip being determined based on a radiation field pattern required and being confined within a small area of said substrate surface, a first end of said metal strip being used to feed in signals and a second end of said metal strip being open;

a grounding device located below said fast-wave resonator, said grounding device being cuboid in shape and provided with a plurality of via holes, some of said via holes having a rectangular shape and some of said via holes having a circular shape, wherein a number and size of the via holes having a rectangular shape and a number and size of the via holes having a circular shape is determined according to a grounding area required to provide a predetermined structural strength, and whereby said grounding device provides a considerable area for grounding in a limited space.

* * * * *